US006270951B1

(12) United States Patent
Michiels et al.

(10) Patent No.: US 6,270,951 B1
(45) Date of Patent: Aug. 7, 2001

(54) SUBSTANTIALLY THERMOGRAPHIC RECORDING MATERIALS WITH IMPROVED STABILITY

(75) Inventors: Eddy Michiels, Lichtaart; Yvan Karel Gilliams, Hever; Geert Defieuw, Bonheiden; Yvan Hoogmartens, Wilrijk, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/460,809

(22) Filed: Dec. 14, 1999

Related U.S. Application Data

(60) Provisional application No. 60/123,445, filed on Mar. 9, 1999.

(30) Foreign Application Priority Data

Dec. 23, 1998 (EP) ..... 98204467

(51) Int. Cl.[7] ..... G03C 1/498

(52) U.S. Cl. ..... 430/617; 430/517; 430/523; 430/619; 430/640

(58) Field of Search ..... 430/617, 619, 430/523, 517, 530, 539, 640, 642

(56) References Cited

U.S. PATENT DOCUMENTS

| | | | | |
|---|---|---|---|---|
| 5,189,007 | | 2/1993 | Aihara et al. | 503/207 |
| 5,882,846 | * | 3/1999 | Vacca et al. | 430/538 |

FOREIGN PATENT DOCUMENTS

| | | |
|---|---|---|
| 0414229 | 2/1991 | (EP) . |
| 0692391 | 1/1996 | (EP) . |
| 9512495 | 5/1995 | (WO) . |

* cited by examiner

*Primary Examiner*—Thorl Chea
(74) *Attorney, Agent, or Firm*—Baker Botts L.L.P.

(57) ABSTRACT

A thermographic recording material, thermally developable under substantially water-free conditions, comprising a support and a thermosensitive element, the thermosensitive element being provided with a protective layer and the thermosensitive element containing a substantially light-insensitive silver salt of an organic carboxylic acid, a reducing agent therefor in thermal working relationship therewith and a binder, wherein the protective layer contains at least one proteinaceous binder and non-opacifying inorganic particles with a weight averaged diameter of less than 1$\mu$m in a concentration of between 5 and 70% by weight with respect to the weight of the protective layer.

16 Claims, No Drawings

SUBSTANTIALLY THERMOGRAPHIC RECORDING MATERIALS WITH IMPROVED STABILITY

This application claims the benefit of the U.S. Provisional Application No. 60/123,445 filed Mar. 9, 1999.

DESCRIPTION

Field of the Invention

The present invention relates to thermographic recording materials with improved shelf-life, improved stability to incident light and improved archivability.

BACKGROUND OF THE INVENTION.

In direct thermal imaging the visible image pattern is formed by imagewise heating of a recording material containing matter that by chemical or physical process changes colour or optical density.

Such direct thermal imaging materials can be rendered photothermographic by incorporating a photosensitive agent which after exposure to UV, visible or IR light is capable of catalyzing or participating in a thermographic process bringing about changes in colour or optical density. Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

EP-A 692 391 discloses a heat-sensitive recording material being suited for use in direct thermal imaging and comprising in the order given:(i) a transparent polymeric support, (ii) a heat-sensitive imaging layer, and (iii) a protective layer characterized in that the protective layer is an opaque layer containing uniformly distributed in an organic hydrophilic polymeric binder at least one opacifying pigment in the form of particulate material some of which protrudes from the surface of said binder and has anti-stick properties with regard to a thermal print head, wherein the opacity of layer (iii) corresponds with an absorption and/or scattering of at least 80% of the light of the visible wavelength range (400 to 700 nm). The invention examples of EP-A 692 391 disclose a protective layer consisting of 11% by weight of gelatin and 89% by weight of opacifying anatase-type titanium dioxide particles.

W095/12495 discloses a method of recording an image by image- wise heating a recording material, the recording material comprising on the same side of a support, called the heat-sensitive side, (1) one or more layers comprising an imaging composition essentially consisting of (i) a substantially light-insensitive organic silver salt being in thermal working relationship with (ii) a reducing agent, and (2) at the same side covering the imaging composition a protective layer, characterized in that the image-wise heating proceeds with a thermal head contacting the heat-sensitive side and through the protective layer mainly comprising a cured polymer or cured polymer composition.

Ever tighter solvent emission regulations and measures to avoid solvent explosions, make the avoidance of solvent emission during the coating of thermosensitive elements with a protective layer desirable. However, coating with protective layers based on polyvinyl alcohol and tetra-alkyl orthosilcates, such as described in W095/12495, or polyvinyl alcohol and polysilicic acid as described in US 4,741,992, results in the emission of alcohols. There is therefore a need for water-based protective coatings for id thermosensitive and photo-addressable thermally developable elements based on substantially light-insensitive organic silver salts and reducing agents with good adhesion and transport properties in a thermographic printer using a thermal head, but without deterioration in thermographic imaging characteristics such as maximum and minimum print densities.

OBJECTS OF THE INVENTION.

It is therefore an object of the present invention to provide a water-based protective layer for thermographic recording materials with good transport and imaging properties.

Further objects and advantages of the invention will become apparent from the description hereinafter.

SUMMARY OF THE INVENTION

The above objects of the present invention are realized by providing a thermographic recording material, thermally developable under substantially water-free conditions, comprising a support and a thermosensitive element, the thermosensitive element being provided with a protective layer and the thermosensitive element containing a substantially light-insensitive silver salt of an organic carboxylic acid, a reducing agent therefor in thermal working relationship therewith and a binder, wherein the protective layer contains at least one proteinaceous binder and non-opacifying inorganic particles with a weight averaged diameter of less than 1 $\mu$m in a concentration of between 5 and 70% by weight with respect to the weight of the protective layer.

Preferred embodiments of the present invention are disclosed in the detailed description of the invention

DETAILED DESCRIPTION OF THE INVENTION.

In a preferred embodiment the substantially light-insensitive thermographic recording materials of the present invention are black and white thermographic recording materials.

Definitions

By substantially light-insensitive is meant not intentionally light sensitive.

By substantially solvent-free aqueous medium is meant that solvent, if present, is present in amounts below 10% by volume of the aqueous medium.

By non-opacifying inorganic particles is meant inorganic particles which do not absorb and/or do not scatter at least 80% of the light of the visible wavelength range (400 to 700 nm) thereby not rendering the layer in which they are present opaque i.e. preventing transmission of visible light by reflection or dispersion.

By the term essentially colourless is meant colourless to the naked eye.

By the term "heat solvent" is meant a non-hydrolyzable organic material which is in a solid state in the recording layer at temperatures below 50° C., but upon heating becomes a plasticizer for the recording layer and/or a liquid solvent for at least one of the redox-reactants.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Non-opacifying inorganic particles

The particle size of the non-opacifying inorganic particles having a weight averaged particle size of less than 1 μm used in the thermographic recording materials according to the present invention may be determined by such techniques as electron microscopy for particle sizes in the range 1 to 10,000 nm, photo-correlation spectroscopy, static light scattering for particle sizes in the range 300 to 1,500 nm, quasi-elastic light scattering (QELS) for the hydrodynamic diameters in the range 10 to 3,000 nm, light scattering particle size analyzers based on Mie scattering or Fraunhofer diffraction e.g. the COULTER™ LS230 from COULTER CORP. which combines Fraunhofer diffraction with polarization intensity differential scattering (PIDS), ultracentrifuge measurements for particle sizes in the range 10 to 20,000 nm in a gravity field of 20 to 200,000g, sedimentation analysis and specific surface area measurements using the BET method according to ISO NORM 9277.1995(E) and DIN NORM 66 131 of October 1973.

Suitable non-opacifying inorganic particles include colloidal silica, china clay and kaolin.

Protective layer

According to the thermographic recording material of the present invention, a thermosensitive element is provided with a protective layer, the protective layer containing at least one proteinaceous binder and non-opacifying inorganic particles with a weight averaged diameter of less than 1 μm, with non-opacifying inorganic particles with a weight averaged diameter 0.4μm or less being preferred and those with a weight averaged diameter of 0.2μm or less being particularly preferred. The concentration of the non-opacifying inorganic particles in the protective layer with respect to the weight of the protective layer is between 5 and 70% by weight, with 15 to 63% by weight being preferred and 20 to 50% by weight being particularly preferred.

In general the protective layer protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating as well as excellent adhesion to the thermosensitive element which they protect.

The non-opacifying inorganic particles are preferably essentially colourless. The protective layer preferably contains a non-cationic surfactant, and may contain a dissolved lubricating material and/or particulate material, e.g. talc particles, optionally protruding from the surface. Examples of suitable lubricating materials are a surface active agent, a liquid lubricant, a solid lubricant or mixtures thereof, which may be used with or without a polymeric binder.

Proteinaceous binders

Suitable proteinaceous binders include gelatin, modified gelatins such as phthaloyl gelatin, zein etc., with gelatin being referred. It is preferred that the halide ion concentration in the proteinaceous binders present in the protective layer together do not exceed 300 ppm, with not exceeding 150 ppm being particularly preferred and not exceeding 100 ppm being especially preferred. The alkali metal ion concentration in the proteinaceous binder(s) used in the protective layer of the thermographic and photothermographic recording materials of the present invention together preferably do not exceed 500 ppm, with not exceeding 100 ppm being particularly preferred and not exceeding 50 ppm being especially preferred.

The halide ion concentration in organic materials can be determined by standard analytical techniques e.g. ion chromatography. The following method using ion chromatography has been found to give reliable and reproducible values for halide ion concentration in proteinaceous binders: 1 ml of 0.IN silver nitrate is added to an accurately weighed sample weighing about 5 g in weight in a 100 ml beaker and then 5 ml of 70% nitric acid is added. The mixture is then boiled for about 15 minutes, whereupon the organic material is decomposed, the chloride ions are released into solution and then are bound by the silver ions forming a silver halide precipitate. After cooling the suspension is filtered in a Millipore™ and the residue thoroughly washed with deionized water. The filter is then transferred to a test-tube with a stopper and 10 ml of 0.008% ammonium sulfide are added. The mixture is then shaken for 20 minutes to convert the silver halide precipitate to a silver sulfide precipitate and release the halide ions into solution. The solution is then injected, after dilution should this be necessary, into a DIONEX™ QIC ANALYSER with an AG3 guard column and an AS3 separator column and the halide ion concentration determined. Chloride ion concentrations down to 10 μg $Cl^-$/ml sample can be detected using this technique.

Alkali metal ions in organic materials can be determined by digesting an accurately weighed ca. 500 mg sample with nitric acid and hydrogen peroxide in a closed destruction system. Then diluting to 25 ml with deionized water and injecting into an inductively coupled plasma to determine the alkali ion concentration.

Table 1 shows that the chloride ion concentration present in gelatin as determined by ion chromatography using a DIONEX QIC ANALYSER ion chromatograph varies according to gelatin type from 5300 to 17 ppm and the sodium ion concentration varies between less than 100 ppm to 2600 ppm:

TABLE 1

| GELATIN type | general description | chloride ion concentration [ppm] | sodium ion concentration [ppm] |
|---|---|---|---|
| GEL01 | low viscosity | 5300 | — |
| GEL02 | hydrolyzed gelatin | 2900 | 1700 |
| GEL03 | calcium-free, low viscosity | 1270 | — |
| GEL04 | calcium-free, medium viscosity | 17 | <100 |
| GEL05 | calcium-free, low viscosity | <40 | 2600 |
| GEL06* | calcium-free, low viscosity | <40 | <100 |
| GEL07 | calcium-containing, medium viscosity | ≦250# | — |
| GEL08 | calcium-free, high viscosity | ≦200# | — |
| GEL09 | calcium-free, medium viscosity | ≦150# | — |

TABLE 1-continued

| GELATIN type | general description | chloride ion concentration [ppm] | sodium ion concentration [ppm] |
|---|---|---|---|
| GEL10 | calcium-containing, low viscosity | 150–300# | — |

*type 17881, a calcium-free gelatin with low potassium ion, sodium ion and chloride-ion concentrations from AGFA-GEVAERT GELATINEFABRIEK
#manufacturer's specification Gelatin can be present in two forms dependent upon amongst other things upon the conditions under which it is dried. Above a temperature of 40° C. a gelatin solution behaves as a normal polyelectrolyte. Upon gelation triple helices are formed. With increasing gelation temperature, the thermostabilization of the gel structures increases slightly because of increasing mobility of the gelatin segments with lead to an ever more perfect triple helix structure as can be seen by the increase in melting point. Upon drying the already formed aggregates of helices orientate in a planar manner, due to adhesion to the support layer. This results in the strong vertical swelling, several hundred % and smaller lateral swelling of layers separated from a support. If the layer temperature is higher, fewer gel structures form and the lateral swelling is greater [see Photographic Gelatin, R. J. Croome and F.

G. Clegg, Focal Press, London (1965)]. If the layer temperature is 10 to 15° C. during the drying process, the so-called gel-form of gelatin is produced with a pronounced triple helix structure as characterized by X-ray diffraction spectra [see Nature 168, 837 (1951)3, whereas drying at temperatures of 20 to 30° C. produces so-called sol-gelatin in which the triple helix structure is substantially absent.

Thermosensitive element

According to the present invention, the thermosensitive element contains a substantially light-insensitive silver salt of an organic carboxylic acid, a reducing agent therefor in thermal working relationship therewith and a binder. By thermal working relationship with one another is meant that during the thermal development process the reducing agent must be present in such a way that it is able to diffuse to the particles of substantially light-insensitive silver salt of an organic carboxylic acid so that reduction thereof can take place. The thickness of the thermosensitive element is preferably in the range of 1 to 50 $\mu$m.

In a particularly preferred embodiment of the present invention the thermosensitive element further contains a photosensitive silver halide, making the thermographic recording material photothermographic.

Silver salts of an organic carboxylic acid

Preferred substantially light-insensitive silver salts of an organic carboxylic acid used in the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention.

Auxiliary film-forming binders of the thermosensitive element

Suitable water-dispersible binders for use as auxiliary binders in the thermographic and photothermographic recording materials of the present invention may be any water-insoluble polymer. It should be noted that there is no clear cut transition between a polymer dispersion and a polymer solution in the case of very small polymer particles resulting in the smallest particles of the polymer being dissolved and those slightly larger being in dispersion Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according the present invention are water-dispersible film-forming polymers with covalently bonded moieties with one or more acid groups.

The above mentioned binders or mixtures thereof may be used in conjunction with waxes or "heat solvents" also called "thermal solvents" or "thermosolvents" improving the reaction speed of the redox-reaction at elevated temperature.

Organic reducing agents

Suitable organic reducing agents for the reduction of silver salt of an organic carboxylic acid particles are organic compounds containing at least one active hydrogen atom linked to 0, N or C, such as is the case with, aromatic di- and tri-hydroxy compounds; aminophenols; METOL™ ; p-phenylene-diamines; alkoxynaphthols, e.g. 4- methoxy-l-naphthol described in US-P 3,094,41; pyrazolidin-3-one type reducing agents, e.g. PHENIDONE>; pyrazolin-5-ones; indan-1,3- dione derivatives; hydroxytetrone acids; hydroxytetronimides; hydroxylamine derivatives such as for example described in US-P 4,082,901; hydrazine derivatives; and reductones e.g. ascorbic acid; see also US-P 3,074,809, 3,080,254, 3,094,417 and 3,887,378.

Catechol-type reducing agents, i.e. reducing agents containing at least one benzene nucleus with two hydroxy groups (-OH) in ortho- position, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4- dihydroxy-benzoic acid esters are preferred, with those described in EP 692 733 and EP-A 903 625 being particularly preferred. Other suitable reducing agents are sterically hindered phenols, bisphenols and sulfonamidophenols.

Combinations of reducing agents may also be used that on heating become reactive partners in the reduction of the substantially light-insensitive silver salt or an organic carboxylic acid. For example, combinations of sterically hindered phenols with sulfonyl hydrazide reducing agents such as disclosed in US-P 5,464,738; trityl hydrazides and formyl-phenyl-hydrazides such as disclosed in US-P 5,496,695; trityl hydrazides and formyl-phenyl-hydrazides with diverse auxiliary reducing agents such as disclosed in US-P 5,545,505, US-P 5.545.507 and US-P 5,558,983; acrylonitrile compounds as disclosed in US-P 5,545,515 and US-P 5,635,339; and 2- substituted malonodialdehyde compounds as disclosed in US-P 5,654,130

Toning agents

In order to obtain a neutral black image tone in the higher densities and neutral grey in the lower densities, the thermographic and photothermographic recording materials according to the present invention may contain one or more toning agents. The toning agents should be in thermal working relationship with the substantially light-insensitive silver salt of an organic carboxylic acid and reducing agents during thermal processing. Any known toning agent from thermography or photothermography may be used. Suitable toning agents are the phthalimides and phthalazinones within the scope of the general formulae described in US-P 4,082,901 and the toning agents described in US-P 3,074,809, US-P 3,446,648 and US-P 3,844,797. Particularly useful toning agents are the heterocyclic toner compounds of the benzoxazine dione or naphthoxazine dione type described in GB-P 1,439,478, US-P 3,951,660 and US-P 5,599,647.

Stabilizers and antifoggants

In order to obtain improved shelf-life and reduced fogging, stabilizers and antifoggants may be incorporated into the thermographic recording materials of the present invention.

Polycarboxylic acids and anhydrides thereof

According to the recording material of the present invention the thermosensitive element may comprise in addition at least one polycarboxylic acid and/or anhydride thereof in a molar percentage of at least 15 with respect to all the silver salt of an organic carboxylic acid(s) present and in thermal working relationship therewith. The polycarboxylic acid may be aliphatic (saturated as well as unsaturated aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Surfactants and dispersants

Surfactants are surface active agents which are soluble compounds which reduce the interfacial tension between a liquid and a solid. The thermographic and photothermographic recording materials of the present invention may contain anionic, non-ionic or amphoteric surfactants e.g.:

Surfactant Nr. S01 =ammonium dodecylphenylsulfonate;

Surfactant Nr. S02 =ANTOROX™ C0630, a nonylphenyloxypenta(ethylene- oxy) non-ionic surfactant supplied by GAF.

Surfactant Nr. S03 =GARFAC™ RM710, a complex organic phosphate ester from GAF;

Surfactant Nr. S04 =ULTRA™ ™ W, an aryl sulfonate from CIBA-GEIGY

Surfactant Nr. S05 =ARKOPAL™ N060 (previously HOSPATAL™ W), a nonylphenylpolyethylene-glycol from HOECHST Surfactant Nr. S06 =SAPONINE QUILAYA, containing 10% of saponines, 15% of tannins, 11% of calcium oxalate and 64% of starch from SCHMITTMANN;

Surfactant Nr. S07 =NIAPROOF ANIONIC™ 4, supplied as a 27% concentrate of a sodium l-(2'-ethylbutyl)-4- ethylhexylsulphate by NIACET;

Surfactant Nr. S08 =ammonium salt of perfluoro-octanoic acid.

Suitable dispersants are natural polymeric substances, synthetic polymeric substances and finely divided powders, for example finely divided non-metallic inorganic powders such as silica.

Other ingredients

In addition to the ingredients the substantially light-insensitive thermographic recording material may contain other additives such as free fatty acids, silicone oil, ultraviolet light absorbing compounds, white light reflecting and/or ultraviolet radiation reflecting pigments and/or optical brightening agents.

Support

The support for the substantially light-insensitive thermographic recording material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form. The support may be subbed with a subbing layer. It may also be made of an opacified resin composition.

Photosensitive silver halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral sensitization

The photosensitive silver halide in the photo-addressable thermally developable element of the photothermographic recording material, according to the present invention, may be spectrally sensitized with a spectral sensitizer, optionally together with a supersensitizer. Various known dyes are suitable spectral sensitizers including cyanine, merocyanine, styryl, hemicyanine, oxonol, hemioxonol and xanthene dyes.

Antihalation dyes

The thermographic recording materials used in the present invention may also contain antihalation or acutance dyes which absorb light which has passed through the photosensitive thermally developable photographic material, thereby preventing its reflection. Such dyes may be incorporated into the photosensitive thermally developable photographic material or in any other layer of the photographic material of the present invention.

Antistatic layer

In a preferred embodiment the thermographic recording material of the present invention an antistatic layer is applied to an outermost layer.

Coating

The coating of any layer of the substantially light-insensitive thermographic recording materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, NY 10010, USA.

Thermographic printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head. Heating takes place in a substantially water-free condition.

In thermal printing, image signals are converted into electric pulses and then through a driver circuit selectively transferred to a thermal printhead. The thermal printhead consists of microscopic heat resistor elements, which convert the electrical energy via the Joule effect into heat, which is transferred to the surface of the thermographic recording material wherein the chemical reaction resulting in the development of a black and white image takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200-500g/$cm^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly e.g. from opto-electronic scanning devices or from an intermediary storage means, optionally linked to a digital image work station wherein the image information can be processed to satisfy particular needs. Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulsewise.

When used in thermographic recording operating with thermal printheads the thermographic recording materials are not suitable for reproducing images with fairly large number of grey levels as is required for continuous tone reproduction. EP-A 622 217 discloses a method for making an image using a direct thermal imaging element producing improvements in continuous tone reproduction.

Image-wise heating of the thermographic recording material can also be carried out using an electrically resistive ribbon incorporated into the material. Image- or pattern-wise heating of the thermographic recording material may also proceed by means of pixelwise modulated ultra-sound, using e.g. an ultrasonic pixel printer as described e.g. in US-P 4,908,631.

Photothermographic printing

Photothermographic recording materials, according to the present invention, may be exposed with radiation of wavelength between an X- ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780nm, 830nm or 850nm; or a light emitting diode, for example one emitting at 659nm; or by direct exposure to the object itself or an image therefrom with appropriate illumination e.g. with UV, visible or IR light.

For the thermal development of image-wise exposed photothermo-graphic recording materials, according to the present invention, any sort of heat source can be used that enables the recording materials to be uniformly heated to the development temperature in a time acceptable for the application concerned e.g. contact heating, radiative heating, microwave heating etc.

Industrial application

Thermographic recording materials according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

While the present invention will hereinafter be described in connection with a preferred embodiment thereof, it will be understood that it is not intended to limit the invention to that embodiment. The following examples and comparative examples illustrate the present invention. The percentages and ratios used in the examples and compositions of the ingredients are by weight unless otherwise indicated.

i) backing layer ingredients:

KELZAN™ S =a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PERAPRE™ PE40 =a 40% aqueous dispersion of polyethylene latex from BASF;

LATEX02, =a 20% by weight dispersion of polymethyl methacrylate with an average particle size of 88.8nm prepared as described in US-P 5,354,613;

LATEX03, =a 15% dispersion of a terpolymer of 18 mol% methyl acrylate, 79 mol% potassium salt of acrylic acid and 3 mol% tetra-allyloxyethane;

LATEX04 =a 20% dispersion of a 1$\mu$m polymethylmethacrylate latex;

KIESELSOL™ 10OF =a colloidal silica from BAYER;

KIESELSOL™ 300F =a colloidal silica from BAYER;

PLEXIGUM™ 345 =a polymethylmethacrylate type from ROHM;

ii) thermosensitive element ingredients (in addition to those mentioned above):

AgB =silver behenate

R01 =ethyl 3,4-dihydroxybenzoate, a reducing agent

T01 =benzo[e](1,3]oxazine-2,4-dione, a toning agent

LATEX 01 =a terpolymer of 42% butyl acrylate, 53% styrene, 2% itaconic acid and 3% of the ammonium salt of N-[(4'-sulfobenzamido)-oxo-decyl]methacrylamide.

iii) protective layer ingredients:

POLY01 =POLYVIOLT WX48 20, a polyvinylalcohol from WACKER CHEMIE;

SYLOID™ 72 =a porous silica from Grace with a similar particle size to SYLOID™ 244;

SYLOID™ 244 =a porous silica with a weight averaged particle size of 3.86μm from Grace;

MICROACE™ P3 =an Indian talc with a particle size of 4.5μm, from Nippon Talc;

STEAMIC™OOS =a talc with a particle size of 28μm, from Talc de Luzenac;

SERVOXYL™ VPAZ 100 =a mixture of monolauryl and dilauryl phosphate, from Servo Delden B.V.;

SERVOXYL™ VPDZ 3/100 =a monolisotridecyl polyglycolether (3 EO)) phosphate, from Servo Delden B.V;

RILANIT™ GMS =a glycerine monotallow acid ester, from Henkel AG;

LEVASIL™ VP AC 4055 =15% aqueous dispersion of colloidal silica with acid groups substantially neutralized with sodium ions and a specific surface area of 500 $m^2/g$, from Bayer AG;

china clay =China Clay Supreme'a supreme china clay type with a weight averaged particle size of 0.4μm, Zinchem-Benelux N.V.;

kaolin =DIXIE Clay with a weight averaged particle size of 0.2μm, from R.T. Vanderbilt Company, Inc.

Preparation of colloidal silica with any acid groups upon acidification substantially neutralized with ammonium ions Colloidal silica with any acid groups upon acidification substantially neutralized with ammonium ions was prepared from LEVASIL™ VP AC 4055 in a two step process. In the first step 10 L of the acidic ion exchange resin LEWATIT™ S1OOMB was added to a mixture of 12L of deionized water and 4L of a 26% aqueous ammonia solution. The dispersion was then stirred for 90 minutes thereby converting the ion exchange resin into its ammonium form. The converted ion exchange resin in the ammonium form was then filtered off and washed with deionized water until the wash-water was neutral. In the second step 5L of the ion exchange resin in the ammonium form was added to 20L of LEVASIL™ VP AC 4055 and the resulting dispersion stirred for 2 hours. The ion exchange resin was then filtered off, a further 5L of the ion exchange resin in the ammonium form added, the dispersion stirred for 2 hours and then the ion exchange resin was filtered off.

COMPARATIVE EXAMPLES 1 & 2 and INVENTION EXAMPLES 4 & 5

Thermosensitive elements

In the coating of the thermosensitive elements of COMPARATIVE EXAMPLES 1 & 3 AND INVENTION EXAMPLES 1 to 6, 175μm thick subbed blue pigmented polyethylene terephthalate support was coated with an aqueous coating composition which upon drying produced a thermosensitive element containing the composition given in table 1.

In the coating of the thermosensitive elements of COMPARATIVE EXAMPLE 2 and INVENTION EXAMPLE 7, 175μm thick subbed blue pigmented polyethylene terephthalate support was coated with an aqueous coating composition and dried at 18 to 20° C. for 93s in a stream of air with a flow rate of 950kg/min to produce the thermosensitive element containing the composition given in table 1.

TABLE 1

| | thermosensitive elements | |
|---|---|---|
| | Comparative examples nr 1 & 3 and Invention examples | Comparative example nr. 2 & Invention example 7 |
| AgBeh | 4.92 $g/m^2$ | 4.94 $g/m^2$ |
| GEL05 | 0.67 $g/m^2$ | 4.53 $g/m^2$ |
| GEL06 | 3.45 $g/m^2$ | — |
| formaldehyde | 0.2 $g/m^2$ | — |
| Surfactant Nr. S01 | 0.256 $g/m^2$ | 0.32 $g/m^2$ |
| Surfactant Nr. S02 | 0.004 $g/m^2$ | 0.004 $g/m^2$ |
| R01 | 1.00 $g/m^2$ | 1.00 $g/m^2$ |
| T01 | 1.08 $g/m^2$ | 1.08 $g/m^2$ |
| boric acid | 0.31 $g/m^2$ | 0.31 $g/m^2$ |

Protective layer

The thermosensitive elements of the thermographic recording materials of INVENTION EXAMPLES 1 to 7 and COMPARATIVE EXAMPLES 1 to 3 were then coated with a protective layer having the compositions given in table 2.

TABLE 2

| | Invention example nr | | | Comparative example nr | | |
|---|---|---|---|---|---|---|
| coverage in $g/m^2$ | 1–5 | 6 | 7 | 1 | 2 | 3 |
| GEL06 | 2.5 | 2.5 | 2.5 | 2.5 | 2.5 | 2.5 |
| Colloidal silica in ammonium form | 0.5 | 0.5 | 0.5 | 0.5 | 0.5 | 0.5 |
| HCHO | 0.2 | 0.4 | 0.87 | 0.4 | 0.87 | 0.4 |
| STEAMIC ™ OOS | 0.045 | 0.045 | 0.045 | 0.045 | 0.045 | 0.045 |
| SYLOID ™ 72 | 0.09 | 0.09 | 0.09 | 0.09 | 0.09 | 0.09 |
| RILANIT ™ GMS | 0.135 | 0.135 | 0.135 | 0.135 | 0.135 | 0.135 |
| SERVOXYL ™ VPAZ 100 | 0.06 | 0.06 | 0.06 | 0.06 | 0.06 | 0.06 |
| SERVOXYL ™ VPDZ 3/100 | 0.075 | 0.075 | 0.075 | 0.075 | 0.075 | 0.075 |
| Surfactant Nr. S02 | 0.11 | 0.11 | 0.11 | 0.11 | 0.11 | 0.11 |

The protective layers of INVENTION EXAMPLES 1 to 7 and COMPARATIVE EXAMPLES 1 to 3 were dried under the conditions given in table 3 to produce protective layers about 3μm thick.

Evaluation of the protective layers

The protective layers were then subjected to lateral swelling tests whereby from a sample of thermographic recording materials with dimensions of 0.3 x 2cm the layer combination on the side of the thermographic recording material coated with the thermosensitive element was detached from the support and its swelling behaviour in water monitored. After 2 minutes in deionized water at room temperature, the increase in length of the thermographic recording materials of INVENTION EXAMPLES 1 to 7 and COMPARATIVE EXAMPLES 1 to 3 was measured This is expressed in table 3 as the % swelling.

The printability of the thermographic recording materials of INVENTION EXAMPLES 1 to 7 and COMPARATIVE EXAMPLES 1 to 3 was investigated in a thermographic printer. The printer was equipped with a thin film thermal head with a resolution of 300 dpi and was operated with a line time of 19ms (the line time being the time needed for printing one line). During this line time the printhead received constant power. The average printing power, being the total amount of electrical input energy during one line time divided by the line time and by the surface area of the heat-generating resistors was 1.6 mJ/dot being sufficient to obtain maximum optical density in each of the substantially light-insensitive thermographic recording materials of INVENTION EXAMPLES 1 to 7. The print quality was visually evaluated on the basis of the following print characteristics:

| printing characteristics | print quality |
|---|---|
| protective layer scoured off by the printing head | poor |
| printing quality good, appearance of protective layer acceptable | good |
| printing quality good, appearance of protective layer good | excellent |

The degree of lateral swelling of the layer composition of the thermographic recording materials of COMPARATIVE EXAMPLES 1 to 3 of above 15% are characteristic of gelatin in the sol-form, whereas that of the layer composition of the thermographic recording material of INVENTION EXAMPLES 3, 6 and 7 with a lateral swelling of 13% is characteristic of a mixture of gelatin in the gel-form with gelatin in the sol-form and that of the layer composition of the thermographic recording material of INVENTION EXAMPLES 1, 2, 4 and 5 with a lateral swelling of between 6 and 10% is characteristic of gelatin substantially in the gel-form.

The protective layers of the thermographic recording materials of COMPARATIVE EXAMPLES 1 to 3 exhibited poor print quality due to the protective layer becoming detached from the thermosensitive element whereas the thermographic recording materials of INVENTION EXAMPLES 1 to 7 exhibited an excellent print quality. It is evident that for protective layer thicknesses of about 3$\mu$m, the adhesion of protective layers with exclusively sol-gelatin is poor, whereas it is satisfactory with gelatin consisting either of a mixture of sol and gel gelatin or of substantially gel-gelatin.

TABLE 3

| | air temperature during drying [° C.] | lateral swelling [%] | print quality |
|---|---|---|---|
| Comparative example nr | | | |
| 1 | 21 | 21 | poor |
| 2 | 25 | 20 | poor |
| 3 | 25 | 17 | poor |
| Invention example nr | | | |
| 1 | 12 | 9.7 | excellent |
| 2 | 12 | 6.1 | excellent |
| 3 | 12 | 12.7 | excellent |
| 4 | 12 | 6.4 | excellent |
| 5 | 12 | 6.7 | excellent |
| 6 | 17 | 13 | excellent |
| 7 | 17 | 13 | excellent |

INVENTION EXAMPLES 8 to 10

Thermosensitive elements of INVENTION EXAMPLES 8 to 10 were 175$\mu$m thick subbed polyethylene terephthalate support the following composition:

| | |
|---|---|
| AgBeh | 4.92 g/m$^2$ |
| GEL06 | 3.96 g/m$^2$ |
| formaldehyde | 0.2 g/m$^2$ |
| Surfactant Nr. S01 | 0.39 g/m$^2$ |
| Surfactant Nr. S02 | 0.004 g/m$^2$ |
| R01 | 1.0 g/m$^2$ |
| T01 | 0.55 g/m$^2$ |
| boric acid | 0.085 g/m$^2$ |
| $(NH_4)_2B_4O_7.10H_2O$ | 0.242 g/m$^2$ |

Protective layer

The thermosensitive elements of the thermographic recording materials of INVENTION EXAMPLES 8 to 10 were then coated with an aqueous coating composition and dried at an air temperature of 12° C. to produce protective layers with the compositions given in table 4. The protective layers of INVENTION EXAMPLES 1 to 7 and COMPARATIVE EXAMPLES 1 to 3 were dried to produce protective layers about 7$\mu$m thick.

TABLE 4

| coverage in g/m$^2$ | Invention example nr 8 | Invention example nr 9 | Invention example nr 10 |
|---|---|---|---|
| Gelatin type | GEL06 | GEL01 | GEL02 |
| Gelatin coverage | 4.29 | 4.29 | 4.29 |
| Colloidal silica in ammonium form | 1.34 | 1.34 | 1.34 |
| HCHO | 0.34 | 0.34 | 0.34 |
| STEAMIC ™ OOS | 0.08 | 0.08 | 0.08 |
| SYLOID ™ 72 | 0.15 | 0.15 | 0.15 |
| RILANIT ™ GMS | 0.23 | 0.23 | 0.23 |
| SERVOXYL ™ VPAZ 100 | 0.1 | 0.1 | 0.1 |
| SERVOXYL ™ VPDZ 3/100 | 0.13 | 0.13 | 0.13 |
| Surfactant Nr. S03 | 0.13 | 0.13 | 0.13 |
| Surfactant Nr. S02 | 0.19 | 0.19 | 0.19 |

Thermographic evaluation

The thermographic recording materials were printed as described for the thermographic recording materials of COMPARATIVE EXAMPLES 1 to 3 and INVENTION EXAMPLES 1 to 7. The minimum densities, $_{min}$, of the prints given in table 5 were measured through a blue filter with a MACBETH™ TR924 densitometer in the grey scale step corresponding to data levels of 0. The D%i, values of the prints produced with the thermographic recording materials of INVENTION EXAMPLES 8 to 10 were found to be strongly dependent upon the type of gelatin used in the protective layer and in particular upon the chloride ion concentration in the gelatin as can be seen from the results in table 5.

TABLE 5

| Invention example nr | gelatin type | gelatin $Cl^-$ concentration in ppm | printing after hardening for 5d at 40° C. $D_{min}$ blue | $\Delta D_{min}$ blue after 3d at 30° C./85% RH |
|---|---|---|---|---|
| 8 | GEL06 | <40 | 0.13 | +0.07 |
| 9 | GEL01 | 5300 | 0.21 | +0.43 |
| 10 | GEL02 | 2900 | 0.20 | +0.45 |

INVENTION EXAMPLES 11 to 14 and COMPARATIVE EXAMPLES 4 and 5

The thermosensitive element described for INVENTION EXAMPLES 8 coated with an aqueous coating composition and dried at an air temperature of 12° C. to produce the thermographic recording materials of INVENTION EXAMPLES 11 to 14 and COMPARATIVE EXAMPLES 4 & 5 having protective layers with the compositions given in table 6.

TABLE 6

| | Invention example nr | | | | Comparative example nr | |
|---|---|---|---|---|---|---|
| coverage in g/m² | 11 | 12 | 13 | 14 | 4 | 5 |
| GEL06 | 4.29 | 4.29 | 4.29 | 4.29 | 4.29 | 5.63 |
| Colloidal silica in ammonium form | 1.34 | 1.61 | — | — | — | — |
| LEVASIL VP AC 4055 | — | — | 1.34 | 1.61 | — | — |
| STEAMIC ™ OOS | 0.08 | 0.08 | 0.08 | 0.08 | 0.08 | 0.08 |
| SYLOID ™ 244 | 0.15 | 0.15 | 0.15 | 0.15 | 0.15 | 0.15 |
| RILANIT ™ GMS | 0.23 | 0.23 | 0.23 | 0.23 | 0.23 | 0.23 |
| SERVOXYL ™ VPAZ 100 | 0.1 | 0.1 | 0.1 | 0.1 | 0.1 | 0.1 |
| SERVOXYL ™ VPDZ 3/100 | 0.13 | 0.13 | 0.13 | 0.13 | 0.13 | 0.13 |
| Surfactant Nr. S03 | 0.13 | 0.13 | 0.13 | 0.13 | 0.13 | 0.13 |
| Surfactant Nr. S02 | 0.19 | 0.19 | 0.19 | 0.19 | 0.19 | 0.19 |
| HCHO | 0.34 | 0.34 | 0.34 | 0.34 | 0.34 | 0.34 |

The printing behaviour was evaluated on the thermographic recording materials of INVENTION EXAMPLES 11 to 14 and COMPARATIVE EXAMPLES 4 and 5 after hardening for 5 days at 40° C. as described for the thermographic recording materials of INVENTION EXAMPLES 1 to 7 and COMPARATIVE EXAMPLES 1 to 3. The results are given in table 9.

TABLE 9

| | coating weight of GEL06 [g/m²] | coating weight of colloidal silica in ammonium form [g/m²] | coating weight of LEVASIL VP AC 4055 [g/m²] | % by weight of inorganic particles | Printing quality |
|---|---|---|---|---|---|
| Invention example nr | | | | | |
| 11 | 4.29 | 1.34 | — | 19.2 | good |
| 12 | 4.29 | 1.61 | — | 22.2 | good |
| 13 | 4.29 | — | 1.34 | 19.2 | excellent |
| 14 | 4.29 | — | 1.61 | 22.2 | excellent |
| Comparative example nr | | | | | |
| 4 | 4.29 | — | — | — | poor |
| 5 | 5.63 | — | — | — | poor |

The results show that the thermographic recording materials of INVENTION EXAMPLES 11 to 14 with gelatin-containing protective layers with non-opacifying inorganic particles with a weight averaged particle size below 1μm in concentrations of 19 and 22% by weight with respect to the weight of the protective layer i.e. colloidal silica in ammonium form and LEVASIL™ VP AC 4055 exhibited good or excellent print quality, whereas the thermographic recording materials of COMPARATIVE EXAMPLES 4 and 5 with gelatin-containing protective layers without such sub-micron inorganic particles a exhibited poor print quality.

INVENTION EXAMPLES 15 to 21

The thermosensitive element described for INVENTION EXAMPLES 8 to 10 was coated with an aqueous coating composition and dried at an air temperature of 120C to produce the thermographic recording materials of INVENTION EXAMPLES 15 to 21 having protective layers with the compositions given in table 8.

TABLE 8

| | Invention example number | | | | | | |
|---|---|---|---|---|---|---|---|
| coverage in g/m² | 15 | 16 | 17 | 18 | 19 | 20 | 21 |
| GEL06 | 4.29 | 4.22 | 3.94 | 3.66 | 3.38 | 3.10 | 2.82 |
| Colloidal silica in ammonium form | 1.34 | 1.41 | 1.69 | 1.97 | 2.25 | 2.53 | 2.82 |
| STEAMIC ™ OOS | 0.08 | 0.08 | 0.08 | 0.08 | 0.08 | 0.08 | 0.08 |
| SYLOID ™ 244 | 0.15 | 0.15 | 0.15 | 0.15 | 0.15 | 0.15 | 0.15 |
| RILANIT ™ GMS | 0.23 | 0.23 | 0.23 | 0.23 | 0.23 | 0.23 | 0.23 |
| SERVOXYL ™ VPAZ 100 | 0.1 | 0.1 | 0.1 | 0.1 | 0.1 | 0.1 | 0.1 |
| SERVOXYL ™ VPAZ 3/100 | 0.13 | 0.13 | 0.13 | 0.13 | 0.13 | 0.13 | 0.13 |

TABLE 8-continued

| coverage in g/m² | Invention example number 15 | 16 | 17 | 18 | 19 | 20 | 21 |
|---|---|---|---|---|---|---|---|
| Surfactant Nr. S03 | 0.13 | 0.13 | 0.13 | 0.13 | 0.13 | 0.13 | 0.13 |
| Surfactant Nr. S02 | 0.19 | 0.19 | 0.19 | 0.19 | 0.19 | 0.19 | 0.19 |
| HCHO | 0.34 | 0.34 | 0.34 | 0.34 | 0.34 | 0.34 | 0.34 |

The printing behaviour was evaluated on the thermographic recording materials of INVENTION EXAMPLES 15 to 21 after hardening for 5 days at 40° C. as described for the thermographic recording materials of INVENTION EXAMPLES 1 to 7 and COMPARATIVE EXAMPLES 1 to 3. The results are given in table 11.

The results of table 11 show that the thermographic recording materials of INVENTION EXAMPLES 15 to 21 with gelatin-containing protective layers with 19.2 to 40.3 % by weight of non-opacifying inorganic particles with a weight averaged particle size below 1 μm with respect to the weight of the protective layer i.e. colloidal in ammonium form all exhibited good print quality.

TABLE 11

| Invention example nr | coating weight of GEL06 [g/m²] | colloidal silica in ammonium form: coating weight [g/m²] | colloidal silica in ammonium form: % by wt in protective layer | print quality |
|---|---|---|---|---|
| 15 | 4.29 | 1.34 | 19.2 | good |
| 16 | 4.22 | 1.41 | 20.2 | good |
| 17 | 3.94 | 1.69 | 24.2 | good |
| 18 | 3.66 | 1.97 | 28.2 | good |
| 19 | 3.38 | 2.25 | 32.2 | good |
| 20 | 3.10 | 2.53 | 36.2 | good |
| 21 | 2.82 | 2.82 | 40.3 | good |

INVENTION EXAMPLES 22 to 27

The thermosensitive element described for INVENTION EXAMPLES 8 to 10 was coated with an aqueous coating composition and dried at an air temperature of 12° C. to produce the thermographic recording materials of INVENTION EXAMPLES 22 to 27 having protective layers with the compositions given in table 12.

TABLE 12

| coverage in g/m² | Invention example number 22 | 23 | 24 | 25 | 26 | 27 |
|---|---|---|---|---|---|---|
| Gelatin GEL06 | 4.29 | 4.29 | 4.29 | 3.66 | 3.38 | 3.10 |
| Colloidal silica in ammonium form | 1.34 | — | — | 1.34 | 0.5 | 0.5 |
| china clay | — | 1.50 | — | — | 1.0 | — |
| STEAMIC ™ OOS | 0.08 | 0.08 | 0.08 | 0.08 | 0.08 | 0.08 |
| SYLOID ™ 244 | 0.15 | 0.15 | 0.15 | 0.15 | 0.15 | 0.15 |
| RILANIT ™ GMS | 0.23 | 0.23 | 0.23 | 0.23 | 0.23 | 0.23 |
| SERVOXYL ™ VPAZ 100 | 0.1 | 0.1 | 0.1 | 0.1 | 0.1 | 0.1 |
| SERVOXYL ™ VPDZ 3/100 | 0.13 | 0.13 | 0.13 | 0.13 | 0.13 | 0.13 |
| Surfactant Nr. S03 | 0.13 | 0.13 | 0.13 | 0.13 | 0.13 | 0.13 |
| Surfactant Nr. S02 | 0.19 | 0.19 | 0.19 | 0.19 | 0.19 | 0.19 |
| HCHO | 0.34 | 0.34 | 0.34 | 0.34 | 0.34 | 0.34 |

The printing behaviour was evaluated on the thermographic recording materials of INVENTION EXAMPLES 22 to 27 after hardening for 5 days at 40° C. as described for the thermographic recording materials of INVENTION EXAMPLES 1 to 7 and COMPARATIVE EXAMPLES 1 to 3. The results are given in table 13.

TABLE 13

| Invention example nr | coating weight of GEL06 [g/m²] | coating weight of colloidal silica in ammonium form [g/m²] | coating weight of china clay [g/m²] | coating weight of kaolin [g/m²] | % by weight of inorganic particles | Printing quality |
|---|---|---|---|---|---|---|
| 22 | 4.29 | 1.34 | — | | 19.2 | good |
| 23 | 4.29 | — | 1.5 | — | 21.0 | good |
| 24 | 4.29 | — | — | 1.5 | 21.0 | good |
| 25 | 4.29 | 1.34 | — | — | 19.2 | good |
| 26 | 4.29 | 0.5 | 1.0 | — | 21.0 | good |
| 27 | 4.29 | 0.5 | — | 1.0 | 21.0 | good |

The results of table 13 show that the thermographic recording materials of INVENTION EXAMPLES 22 to 27 with gelatin-containing protective layers with different non-opacifying inorganic particles with a weight averaged particle size below 1μm in concentrations of 19 and 21% by weight with respect to the weight of the protective layer i.e. colloidal silica in ammonium form, china clay and kaolin all exhibited good print quality.

INVENTION EXAMPLES 28 and 29

Backside layers

A 175μm thick polyethylene terephthalate support coated on both sides with subbing layer 01 was coated on one side with backside layer B01 with the following composition:

| | |
|---|---|
| KELZAN ™ S | 10 mg/m² |
| polyethylenedioxythiophene | 5 mg/m² |
| polystyrene sulfonic acid | 10 mg/m² |
| Surfactant Nr. S04 | 21 mg/m² |
| PERAPRET ™ PE40 | 10 mg/m² |
| KIESOLSOL ™ 100F | 20 mg/m² |
| PMMA latex | 200 mg/m² |
| LATEX02 | 30 mg/m² |

A 175μm thick polyethylene terephthalate support coated on both sides with subbing layer 01 was also coated on one side with backside layer packet B02. First a layer with the following composition was coated:

| | |
|---|---|
| GEL07 | 380 mg/m$^2$ |
| KIESELSOL 300F | 340.7 mg/m$^2$ |
| Surfactant Nr. S04 | 13.3 mg/m$^2$ |
| Surfactant Nr. S05 | 6.7 mg/m$^2$ |
| 2-methyl-2,4-pentanediol | 22.2 mg/m$^2$ |
| Trimethylolpropane | 11.1 mg/m$^2$ |
| PMMA latex | 1 mg/m$^2$ |

then with a layer with the following composition:

| | |
|---|---|
| GEL05 | 300 mg/m$^2$ |
| LATEX03 | 450 mg/m$^2$ |
| Surfactant Nr. S07 | 3 mg/m$^2$ |
| Surfactant Nr. S08 | 1 mg/m$^2$ |
| Polystyrene sulfonic acid | 8 mg/m$^2$ |

and finally with a layer of composition:

| | |
|---|---|
| GEL08 | 1266 mg/m$^2$ |
| GEL09 | 100 mg/m$^2$ |
| GEL10 | 130 mg/m$^2$ |
| Surfactant Nr. S06 | <5 mg/m$^2$ |
| Surfactant Nr. S07 | 80 mg/m$^2$ |
| Surfactant Nr. S08 | 3 mg/m$^2$ |
| anti-bacterial agent | 50 mg/m$^2$ |
| LATEX04 | 100 mg/m$^2$ |
| PLEXIGUM ™ M345 | 50 mg/m$^2$ |
| dioctadecyl phthalate | 5 mg/m$^2$ |
| formaldehyde | 106 mg/m$^2$ |
| sodium sulphate | 1 mg/m$^2$ |

Thermosensitive element

A 175$\mu$m thick polyethylene terephthalate support with an uncoated subbing layer 01 on one side and backing layer B01 on the other was used for the thermographic recording material of INVENTION EXAMPLE 28 and a 175$\mu$m thick polyethylene terephthalate support with uncoated subbing layer 01 on one side and backing layer B02 on the other was used for the thermographic recording material of INVENTION EXAMPLE 29.

A thermosensitive element of the following composition was applied in each case to the side coated with subbing layer 01:

| | thermosensitive element of INVENTION EXAMPLE 28 | thermosensitive element of INVENTION EXAMPLE 29 |
|---|---|---|
| AgB | 5.031 g/m$^2$ | 5.268 g/m$^2$ |
| Surfactant Nr. S01 | 0.503 g/m$^2$ | 0.527 g/m$^2$ |
| GEL05 | 2.660 g/m$^2$ | 2.785 g/m$^2$ |
| LATEX 01 | 1.843 g/m$^2$ | 1.929 g/m$^2$ |
| R01 | 0.956 g/m$^2$ | 1.001 g/m$^2$ |
| T01 | 1.132 g/m$^2$ | 1.185 g/m$^2$ |
| Boric acid | 0.325 g/m$^2$ | 0.340 g/m$^2$ |
| HCHO | 0.192 g/m$^2$ | 0.201 g/m$^2$ |

Protective layers

The thermosensitive elements of the thermographic recording materials of INVENTION EXAMPLES 28 and 29 were then coated with a protective layer with the following composition:

| | |
|---|---|
| GEL06 | 4.29 g/m$^2$ |
| colloidal silica in ammonium form | 1.34 g/m$^2$ |
| STEAMIC ™ OOS | 0.08 g/m$^2$ |
| SYLOID ™ 72 | 0.15 g/m$^2$ |
| RILANIT ™ GMS | 0.23 g/m$^2$ |
| SERVOXYL ™ VPDZ 3/100 | 0.10 g/m$^2$ |
| SERVOXYL ™ VPAZ 100 | 0.13 g/m$^2$ |
| Surfactant Nr. S03 | 0.13 g/m$^2$ |
| Surfactant Nr. S02 | 0.19 g/m$^2$ |
| Formaldehyde | 0.34 g/m$^2$ |

Curl evaluation experiments

Curl evaluation experiments were carried out by hanging 24x30 cm$^2$ sheets for 4 hours at 20° C. and 10% and 85% relative humidity respectively in analogy with ISO Norm 4330 - 1979 (E) and then evaluating the degree of curl with a curl-meter The curl values in table 14 are the reciprocal of the curl radius in metres.

TABLE 14

| Invention example number | Curl at room temperature & 10% RH | Curl at room temperature & 85% relative humidity (RH) |
|---|---|---|
| 28 | <10 | 5 |
| 29 | 10 | 3.7 |

From these tests it is clear that the thermographic recording material with the gelatin backing layer INVENTION EXAMPLE 29 exhibits significantly less curl than the thermographic recording material with the polymethylmethacrylate-based backing layer of INVENTION EXAMPLE 28.

Having described in detail preferred embodiments of the current invention, it will now be apparent to those skilled in the art that numerous modifications can be made therein without departing from the scope of the invention as defined in the following claims.

We claim:

1. A thermographic recording material, thermally developable under substantially water-free conditions, comprising a support and a thermosensitive element, said thermosensitive element being provided with a protective layer and said thermosensitive element containing a substantially light-insensitive silver salt of an a organic carboxylic acid, a reducing agent therefor in thermal working relationship therewith and a binder, wherein said protective layer consists essentially of at least one proteinaceous binder and non-opacifying inorganic particles with a weight averaged diameter of less than 1$\mu$m in a concentration of between 5 and 70% by weight with respect to the weight of said protective layer, and wherein said proteinaceous binders in said protective layer together contain less than 300 ppm of halide ion.

2. Thermographic recording material according to claim 1, wherein said non-opacifying inorganic particles have a weight averaged diameter of 0.5 $\mu$m or less.

3. Thermographic recording material according to claim 1, wherein said non-opacifying inorganic particles have a weight averaged diameter of 0.2 $\mu$m or less.

4. Thermographic recording material according to claim 1, wherein said concentration of said non-opacifying inorganic particles in said protective layer is between 15 and 63% by weight with respect to the weight of said protective layer.

5. Thermographic recording material according to claim 1, wherein said concentration of said non-opacifying inorganic particles in said protective layer is between 20 and 50% by weight with respect to the weight of said protective layer.

6. Thermographic recording material according to claim 1, wherein said proteinaceous binders in said protective layer together contain less than 150 ppm of halide ions.

7. Thermographic recording material according to claim 1, wherein said proteinaceous binders in said protective layer together contain less than 100 ppm of halide ions.

8. Thermographic recording material according to claim 8, wherein said halide ion is a chloride ion.

9. Thermographic recording material according to claim 1, wherein said proteinaceous binder(s) in said protective layer together contain an alkali metal ion concentration of 500 ppm or less.

10. Thermographic recording material according to claim 1, wherein said proteinaceous binder(s) in said protective layer together contain an alkali metal ion concentration of 100 ppm or less.

11. Thermographic recording material according to claim 1, wherein said proteinaceous binder(s) in said protective layer together contain an alkali metal ion concentration of 50 ppm or less.

12. Thermographic recording material according to claim 1, wherein at least one of said proteinaceous binders in said protective layer is gelatin.

13. Thermographic recording material according to claim 13, wherein said gelatin is at least 20% in the gel-form.

14. Thermographic recording material according to claim 1, wherein said binder in said thermosensitive element is a proteinaceous binder.

15. Thermographic recording material according to claim 1, wherein said thermographic recording material is provided with a backing layer on the opposite side of said support to said thermosensitive element,and wherein said backing layer contains a proteinaceous binder.

16. Thermographic recording material according to claim 1, wherein said thermosensitive element further contains a photosensitive silver halide.

* * * * *